US005181894A

United States Patent [19]

Shieng

[11] Patent Number: 5,181,894

[45] Date of Patent: Jan. 26, 1993

[54] SKI-PRACTICING DEVICE

[76] Inventor: Chen M. Shieng, No. 1-18, Tuku Tsun, Jenteh Hsiang, Taihan Hsien, Taiwan

[21] Appl. No.: 885,944

[22] Filed: May 19, 1992

[51] Int. Cl.[5] ..... A63B 22/00

[52] U.S. Cl. ..... 482/70; 482/118

[58] Field of Search ..... 482/62, 70, 66, 51, 482/71, 79, 114, 118

[56] References Cited

U.S. PATENT DOCUMENTS

| | | | |
|---|---|---|---|
| 2,772,881 | 12/1956 | Fundom | 482/70 |
| 4,741,527 | 5/1988 | Nestegard | 482/62 |
| 4,948,121 | 8/1990 | Haaheim et al. | 482/70 |
| 5,125,648 | 6/1992 | Olschansky et al. | 482/62 |

*Primary Examiner*—Stephen R. Crow

*Attorney, Agent, or Firm*—Poms, Smith, Lande & Rose

[57] ABSTRACT

A ski-practicing device includes front and rear base members and two longitudinal members disposed in parallel therebetween. A sliding pedal is slidably mounted on each longitudinal member to provide a foot rest. A sliding member is slidably mounted in each longitudinal member. A stick assembly is pivotally attached to each sliding member by a pivotal plate, thereby allowing the stick assembly to be slidable relative to the longitudinal member via the sliding member. Such an arrangement also allows an outward pivotal movement of the stick assembly and the pivotal plate relative to the sliding member, and allows forward and rearward pivotal movement of the stick assembly relative to the pivotal plate.

3 Claims, 5 Drawing Sheets

SKI-PRACTICING DEVICE

BACKGROUND OF THE INVENTION

The present invention relates to a ski-practicing device which provides stimulations of actual skiing motions.

Conventional ski-practicing devices are limited in function since the sticks thereof are fixed and cannot simulate actual motions during skiing. Therefore, there has been a long and unfulfilled need for a ski-practicing device to provide simulations of actual skiing motions.

SUMMARY OF THE INVENTION

The present invention provides a ski-practicing device which includes front and rear base members and two longitudinal members disposed in parallel therebetween. A sliding pedal is slidably mounted on each longitudinal member. A sliding means is slidably mounted in each longitudinal member.

The ski-practicing device further includes a stick assembly pivotally attached to each sliding means by a pivotal means, thereby allowing the stick assembly slidable relative to associated longitudinal member via the sliding means, and allowing an outward pivotal movement of the stick assembly and the pivotal means relative to the sliding means. Furthermore, the stick assembly is forward and rearward pivotal relative to the pivotal means.

Other advantages and novel features of the invention will become more apparent from the following detailed description when taken in conjunction with the accompanying drawings.

DETAILED DESCRIPTION OF THE PREFERRED EMBODIMENTS

Figure 1:
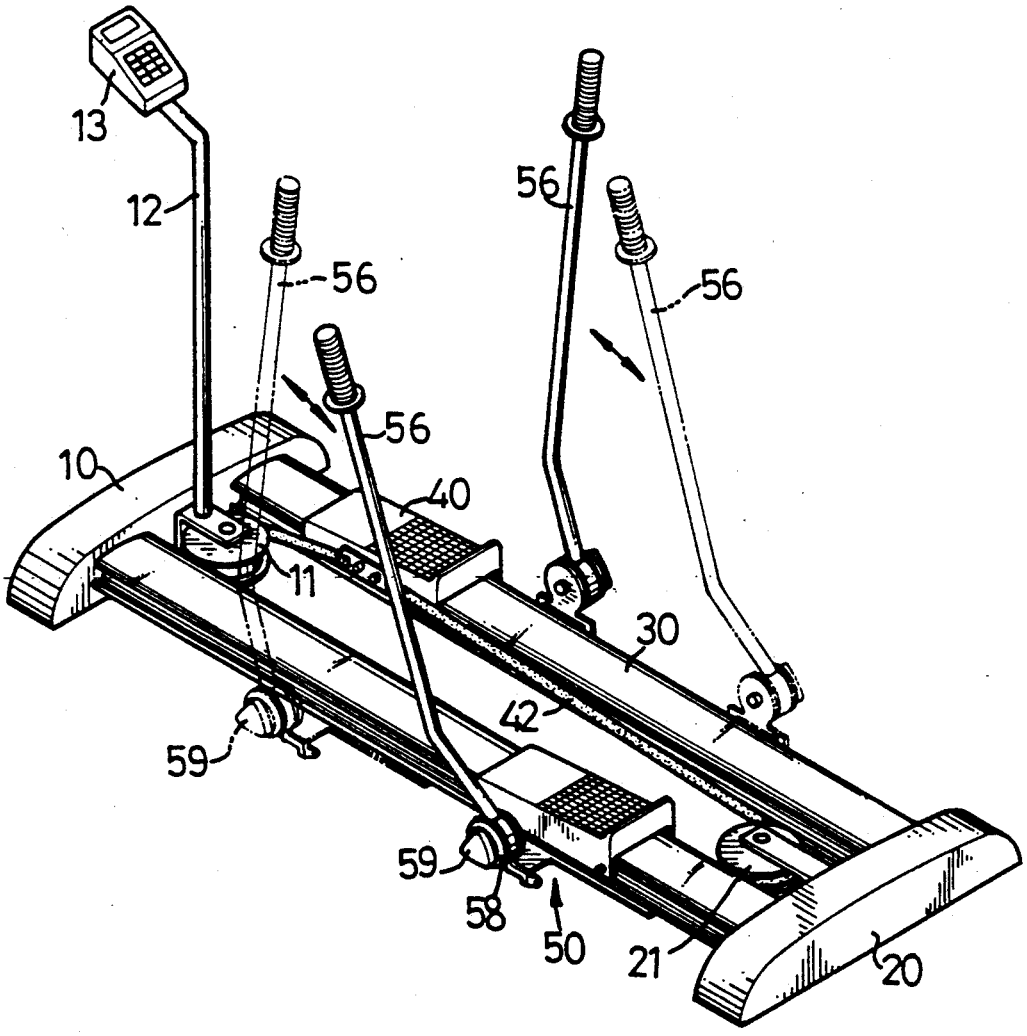
FIG. 1 is a perspective view of a ski-practicing device in accordance with the present invention.

Referring to the drawings and initially to FIG. 1, a ski-practicing device in accordance with the present invention generally includes front and rear base members 10 and 20 and two longitudinal members 30 disposed in parallel therebetween, thereby forming a substantially rectangular frame. Still referring to FIG. 1, and further to FIGS. 2 and 3, a sliding pedal 40 is slidably mounted on each longitudinal member 30 by means of two rollers 41 disposed in outer tracks 31 formed on both sides of each longitudinal member 30.

Pulleys 11 and 21 are provided in the rectangular frame formed by the front and rear base members 10 and 20 and longitudinal members 30, and is provided with a belt 42 to connect the pulleys 11 and 21 and the sliding pedals 40. Furthermore, a display means 13 is mounted by a post 12, by which the sliding speed of the sliding pedals 40 are shown. However, such a structure illustrated in this paragraph is conventional and therefore no further description is required.

Figure 2:
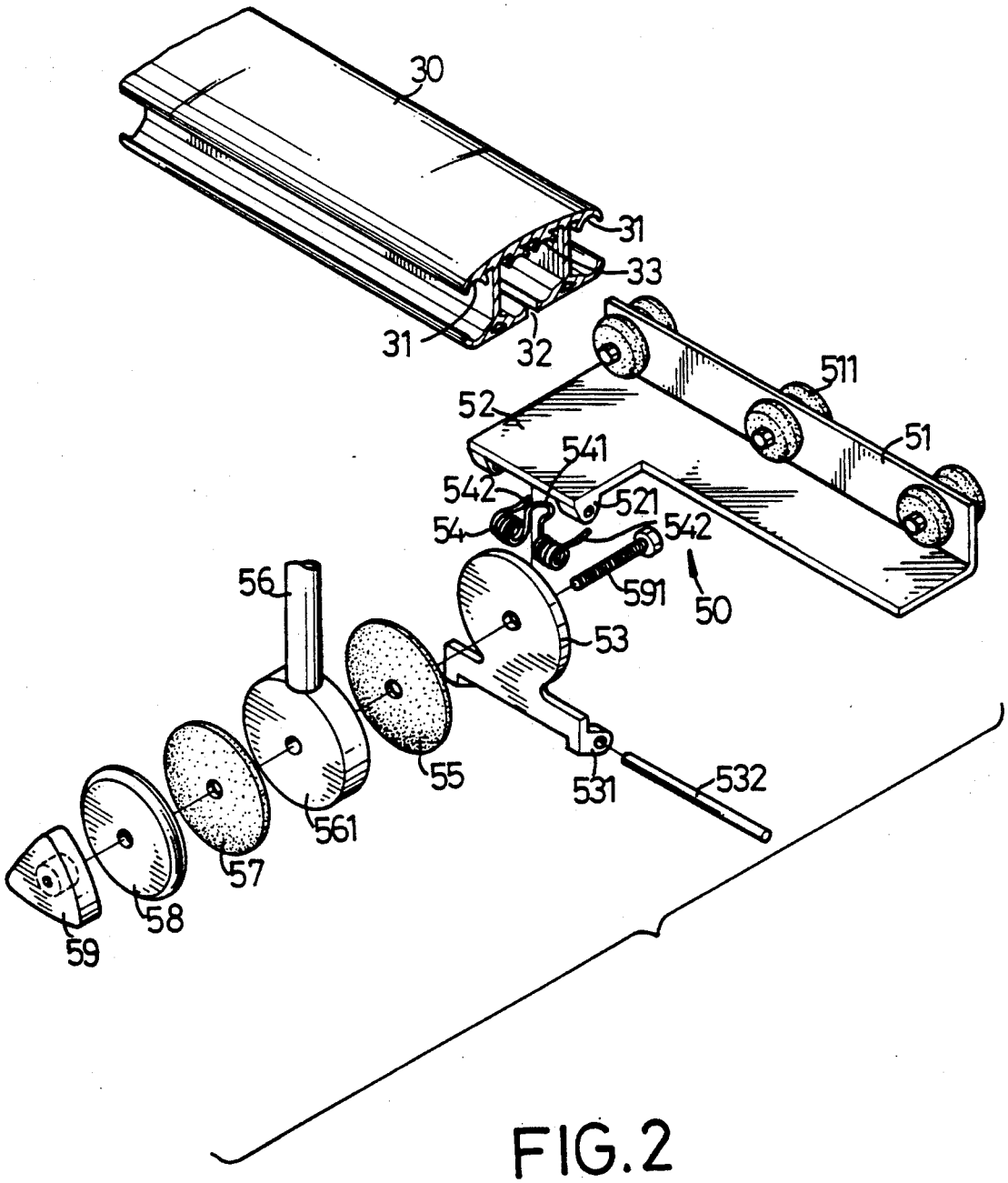
FIG. 2 is an exploded view showing the structure of a stick assembly of the ski-practicing device in accordance with the present invention.
Figure 3:
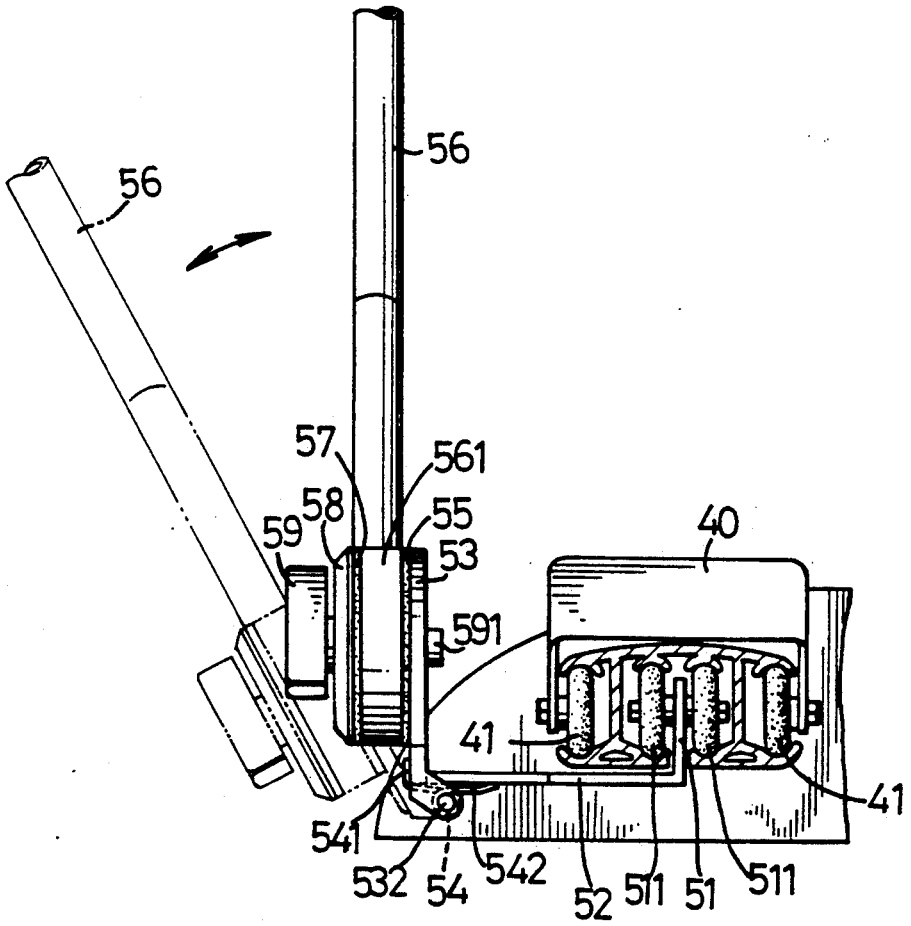
FIG. 3 is a fragmentary front elevational view, partly sectioned, showing an outward pivotal movement of the stick.

The ski-practicing device further includes a stick assembly which is slidable along each longitudinal member by means of a sliding means 50. Referring to FIGS. 2 and 3, the sliding means 50 includes a substantially L-shaped plate having a vertical portion 51 on which three pairs of rollers 511 are mounted and a horizontal portion 52 on which two protrusions 521 are formed. The rollers 511 are slidable in inner tracks formed in the longitudinal members 30.

Figure 4:
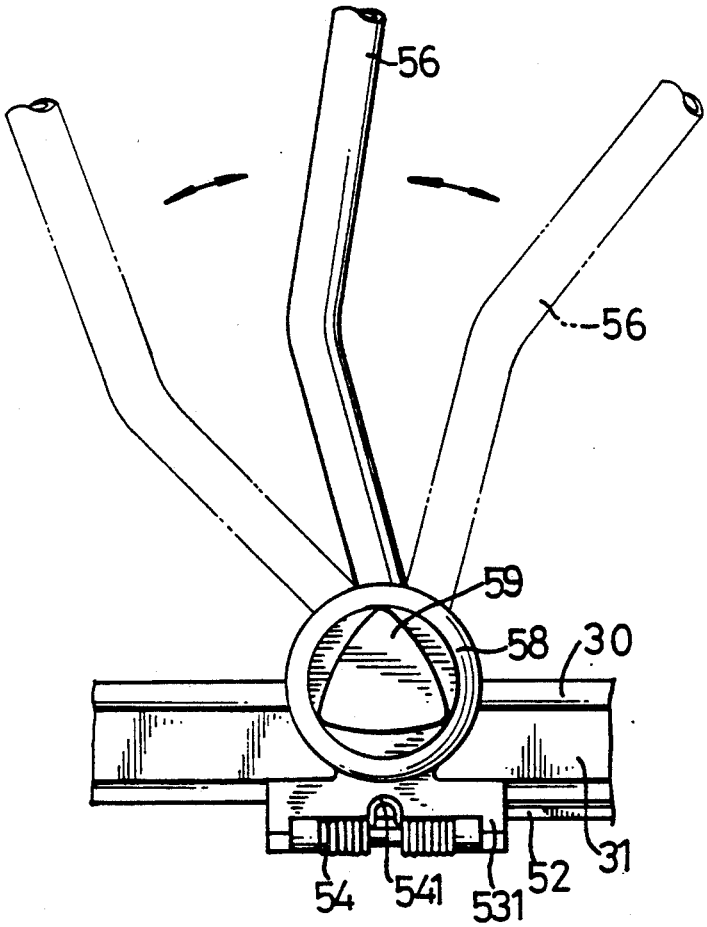
FIG. 4 is a schematic side elevational view showing frontward and rearward pivotal movement of the stick.

The stick assembly is mounted on the plate such that the stick is outward, forward, and rearward pivotable, of which the following describes the details. The stick assembly includes a stick 56 with a disc 561 at a bottom end thereof, first and second positioning plates 55 and 57 of plastic material respectively provided on both outer and inner sides of the disc 561, an end plate 58 attached to an outer side of the first positioning plate 55, and an adjusting cap 59 attached to an outer side of the end plate 58. A pivotal plate 53 is attached to an inner side of the second positioning plate 53. A bolt 591 is provided to secure the adjusting cap 59, the end plate 58, the positioning plates 55 and 57, the disc 561, and the pivotal plate 53 together, thereby allowing a frontward and rearward pivotal movement of the stick 56 relative to the pivotal plate 53, as shown in FIG. 4. The pivotal plate 53 includes two protrusions 531 adapted to be mounted adjacent to the protrusions 521 of the horizontal portion of the sliding means 50 by a pin 532. A torsion spring 54 is provided between the two protrusions 521 with two abutting ends 541 thereof attached to an outer side of the pivotal plate 53 and with a central abutting portion 542 thereof attached to an underside of the horizontal portion, thereby allowing an outward pivotal movement of the whole stick assembly, as shown in FIG. 3. Nevertheless, it is understood that torsion springs of other types can be used to perform the same function.

By such arrangement, when a user stands on the sliding pedals 40 and urges a rearward force on the sticks 56, the sticks 56 move rearward due to a rearward sliding of the sliding means 50. Such a function is a simulation to an actual movement during skiing, which cannot be achieved by prior art. Furthermore, outward, frontward, and rearward pivotal movement of the sticks 56 are also simulations of actual movements during skiing and provides an additional function as an exerciser, which also cannot be achieved by prior art. Incidentally, an adjustment of the adjusting cap 59 results in a change of the force required to move the sticks, thereby providing a function as an exerciser.

Figure 5:
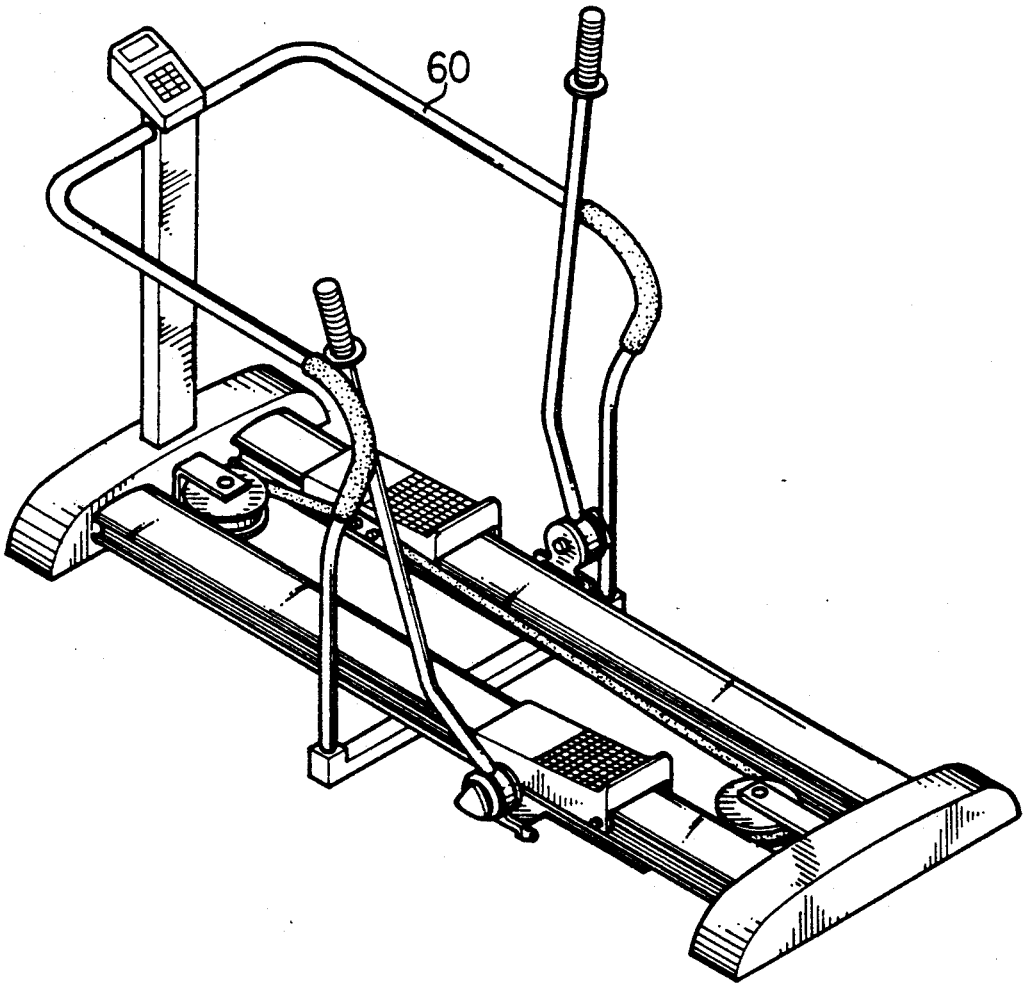
FIG. 5 is a perspective view showing another embodiment in accordance with the present invention.

FIG. 5 shows another embodiment of the ski-practicing device in which an additional handrail 60 is provided which functions as fixed sticks in prior art, thereby providing alternative choices for users.

Although the invention has been explained in relation to its preferred embodiment, it is to be understood that many other possible modifications and variations can be made without departing from the spirit and scope of the invention as hereinafter claimed.

I claim:

1. A ski-practicing device comprising:

front and rear base members and two longitudinal members disposed in parallel relation therebetween, a sliding pedal being slidably mounted on each said longitudinal member;

a sliding means slidably mounted in each said longitudinal member;

a stick assembly pivotally attached to each said sliding means by a pivotal means, thereby allowing said stick assembly to be slidable relative to said longitudinal member via said sliding means, and allowing an outward pivotal movement of said stick assembly and said pivotal means relative to said sliding means, said stick assembly being forward and rearward pivotal relative to said pivotal means wherein said sliding means comprises a substantially L-shaped plate having a vertical portion on which rollers are mounted to be slidable in inner tracks formed in said longitudinal member and a horizontal portion to which said stick assembly is attached.

2. The ski-practicing device as claimed in claim 1, wherein said stick assembly comprises a stick with a disc at a bottom end thereof, first and second positioning plates respectively provided on outer and inner sides of said disc, an end plate attached to an outer side of said first positioning plate, said pivotal means being attached to an inner side of said second positioning plate, a bolt being provided to secure said end plate, said first and second positioning plates, said disc, and said pivotal means together, thereby allowing said forward and rearward pivotal movement of said stick relative to said pivotal means, said horizontal portion of said pivotal means having two spaced protrusions with a torsion spring mounted therebetween, said pivotal means comprising two second protrusions adapted to be mounted adjacent to said protrusions of said horizontal portion of said sliding means by a pin, thereby allowing said outward pivotal movement of said stick assembly relative to said sliding means.

3. The ski-practicing device as claimed in claim 2, further comprising an adjusting cap provided outside said end plate, whereby an adjustment of said adjusting cap results in a change of a force required to move said stick.

* * * * *

UNITED STATES PATENT AND TRADEMARK OFFICE

CERTIFICATE OF CORRECTION

PATENT NO. : 5,181,894

DATED : January 26, 1993

INVENTOR(S) : Meng Shieng Chen

It is certified that error appears in the above-indentified patent and that said Letters Patent is hereby corrected as shown below:

On title page, item [19] should read --Chen-- item [76] Inventor: "Chen M. Shieng" should read --Meng Shieng Chen--

Item [76] inventor's city of residence should read --Tainan Hsien--

Signed and Sealed this

Sixteenth Day of November, 1993

*Attest:*

*Attesting Officer*

Bruce Lehman

BRUCE LEHMAN

*Commissioner of Patents and Trademarks*